United States Patent [19]

Gallegos, Sr.

[11] 3,968,344

[45] July 6, 1976

[54] WARMTH INTO OR ON TOILET SEATS

[75] Inventor: Donald L. Gallegos, Sr., Chama, N. Mex.

[73] Assignee: Lawrence Peska Associates, Inc., New York, N.Y. ; a part interest

[22] Filed: June 30, 1975

[21] Appl. No.: 591,346

[52] U.S. Cl. ..... 219/217; 219/528; 219/529; 219/535; 219/536; 219/549

[51] Int. Cl.[2] ..... H05B 1/00

[58] Field of Search ..... 219/217, 528, 529, 535, 219/536, 549; 128/376; 4/242, 245

[56] References Cited

UNITED STATES PATENTS

| | | | |
|---|---|---|---|
| 2,706,767 | 4/1955 | Packchanian | 219/529 |
| 2,773,167 | 12/1956 | Arbaugh | 219/535 X |
| 2,985,742 | 5/1961 | Rea | 219/535 X |
| 3,423,574 | 1/1969 | Shomphe et al. | 219/528 |

*Primary Examiner*—C. L. Albritton

[57] ABSTRACT

A toilet seat is heated by a resilient cover having a heating element, the cover arranged to be detachably secured to the toilet seat.

4 Claims, 2 Drawing Figures

WARMTH INTO OR ON TOILET SEATS

BACKGROUND OF INVENTION

The discomfort one experiences when sitting on a cold toilet seat has, for many years, been recognized as objectionable and efforts to surmount this annoyance are illustrated in several patents including for example U.S. Pat. Nos. 3,073,937, 2,972,034 and 3,045,096. The former patents suggest various ways of embedding electrical heating elements in the toilet seat itself; while the latter patent shows an arrangement by which the heating element is embedded in a rigid seat cover hingedly carried by a mounting associated with the toilet seat such that the heating element is energized only when the hinged cover is lowered onto the seat. While any one of the devices of the prior art may be effective they are built-in and hence require complete replacement of existing toilet seats. Moreover seats with built-in heating elements are relatively expensive and in the case of the toilet seat of U.S. Pat. No. 3,045,096 both expensive and of highly complex construction.

It is desirable therefore to provide some way for heating a toilet seat that will not entail buying an entirely new seat, which will be inexpensive and, moreover, may or may not be used depending upon circumstances.

SUMMARY OF INVENTION

The present invention relates in general to heated toilet seats and more particularly to toilet seat heating means adapted to be detachably affixed to existing toilet seats; which is inexpensive, and further, is constructed of a relatively soft padded material designed to insure comfort as well as avoid wetness. Moreover the seat cover of this invention may be washed thus insuring its sanitary condition at all times.

PREFERRED EMBODIMENT OF INVENTION

Figure 1:
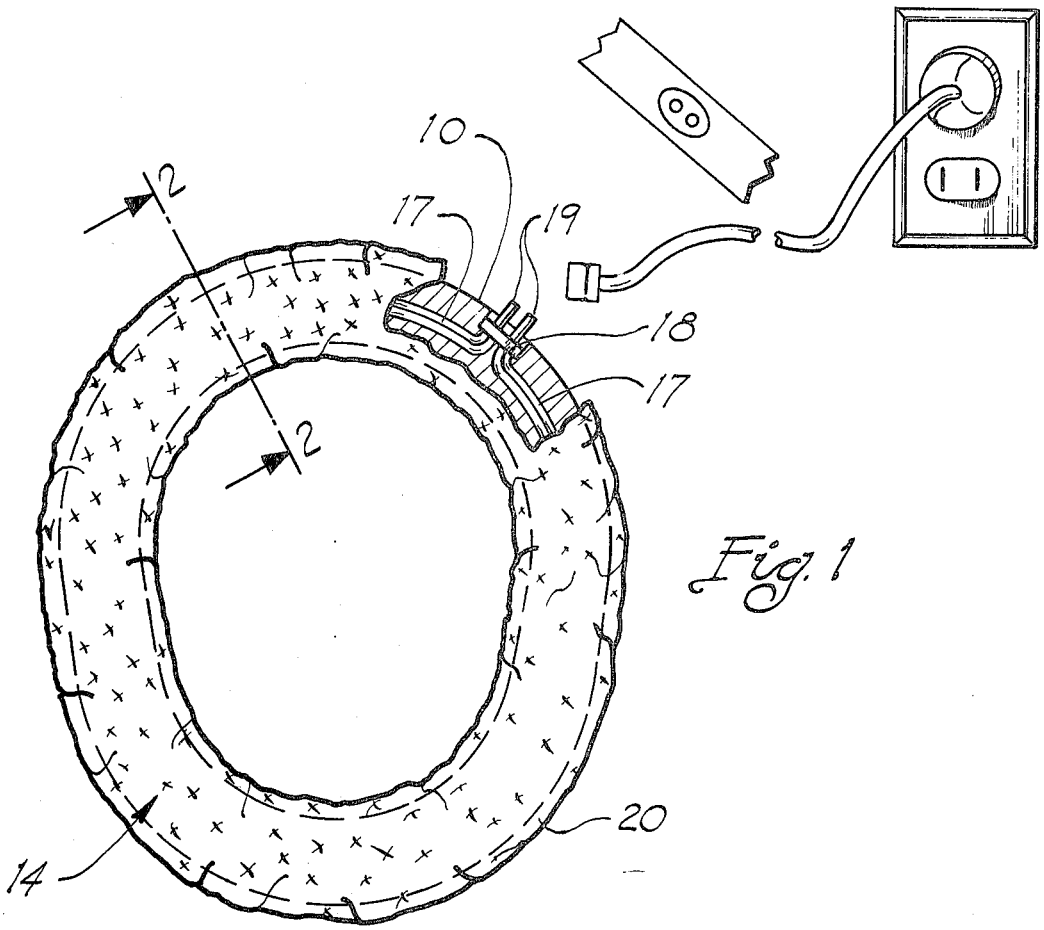
FIG. 1 is a plan view of the heated toilet seat of this invention partly broken away to show the construction of the detachable cover.
Figure 2:
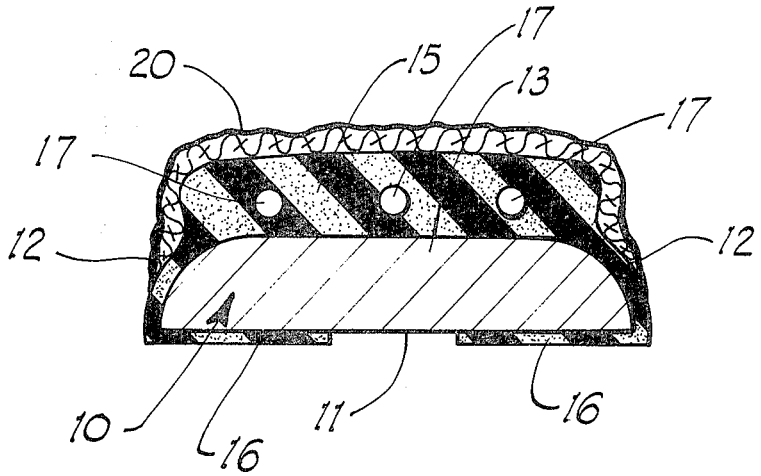
FIG. 2 is a transverse section, in elevation, of the seat and cover on line 2—2 of FIG. 1.

Referring to FIG. 1 the toilet seat indicated at 10 is of usual design and construction and as shown in FIG. 2 comprises a substantially flat bottom surface 11, rounded sides 12—12, and a smooth somewhat rounded top surface 13. Persuant to the objects and advantages of the instant invention the toilet seat is not altered physically in any way but is heated by cover-means arranged to be detachably mounted thereon.

The cover-means is indicated generally at 14 and as shown in FIG. 1 conforms in shape, generally, to the shape of the toilet seat. The cover-means comprises a resilient material 15 such as for example sponge rubber, polyurethane foam, or the like, and in the interest of comfort is a relatively thick pad its thickness being at least equal to and preferably somewhat greater than that of the toilet seat. The pad 15 is adapted to be detachably secured to the toilet seat and to this end fastening means are provided which as shown especially well in FIG. 2 comprise the edges 16—16 of the pad 15. The edges 16 are formed integrally with the pad but are of relatively thin cross section and turned inwardly with a permanent set so as to underlie and firmly engage the bottom 11 of the toilet seat thereby holding the pad securely thereon. It will be apparent however that the pad may be readily removed by flexing its edges 16—16 outwardly.

The pad 15 is provided with electrical heating elements in the form insulated resistance wires 17. In the present embodiment of the invention three resistance wires are shown but it will be understood that the number may be varied. The ends of the resistance wires are soldered to a terminal block 18 provided with terminal posts 19 for plugging the heating wires into any convenient wall outlet or the like.

The resilient pad 15 is shown with a decorative covering 20 which may be a waterproof fabric or the like removably secured in any suitable manner preferably by ties to the pad such that the decorative covering 20 may be readily removed from the pad 15 for washing or for changing decor.

The invention also includes a modification of the heated pad wherein the latter is formed of a fabric material of a quilted or blanket-like construction the insulated heating elements being mounted therein. In this embodiment the fabric pad may be detachably secured to the toilet seat by suitable ties, and the fabric itself of decorative design.

The invention may be carried out in other specific ways than those herein set forth without departing from the spirit and essential characteristics of the invention and the present embodiment is therefore to be considered in all respects as illustrative and not restrictive, and all changes coming within the meaning and equivalency range of the appended claims are intended to be embraced therein.

I claim:

1. An electrically heated toilet seat pad said pad comprising a resilient material having the configuration of a toilet seat, said pad having integrally formed inturned edges on its underside, and heating elements in said pad arranged to be connected to a wall outlet said integrally formed inturned edges comprising flexible fastening means arranged to detachably secure said pad to said toilet seat.

2. An electrically heated toilet seat pad according to claim 1 wherein said resilient material comprises polyurethane foam.

3. An electrically heated toilet seat pad according to claim 2 wherein said pad is provided with a decorative covering arranged to be detachably secured on said pad.

4. An electrically heated toilet seat pad according to claim 3 wherein said decorative covering comprises a waterproof material.

* * * * *